US009739181B2

(12) United States Patent
Ozawa

(10) Patent No.: US 9,739,181 B2
(45) Date of Patent: Aug. 22, 2017

(54) HYDRAULIC LASH ADJUSTER

(71) Applicant: NITTAN VALVE CO., LTD., Kanagawa (JP)

(72) Inventor: Hiroyuki Ozawa, Kanagawa (JP)

(73) Assignee: NITTAN VALVE CO., LTD., Hadano-Shi (JP)

( * ) Notice: Subject to any disclaimer, the term of this patent is extended or adjusted under 35 U.S.C. 154(b) by 0 days.

(21) Appl. No.: 15/306,432

(22) PCT Filed: Dec. 9, 2014

(86) PCT No.: PCT/JP2014/082520

§ 371 (c)(1),
(2) Date: Oct. 24, 2016

(87) PCT Pub. No.: WO2016/038753

PCT Pub. Date: Mar. 17, 2016

(65) Prior Publication Data

US 2017/0044937 A1 Feb. 16, 2017

(51) Int. Cl.

| | |
|---|---|
| ***F01L 1/14*** | (2006.01) |
| ***F01L 1/245*** | (2006.01) |
| ***F01L 1/24*** | (2006.01) |

(52) U.S. Cl.

CPC ..... *F01L 1/245* (2013.01); *F01L 1/2405* (2013.01); *F01L 1/14* (2013.01); *F01L 2001/2444* (2013.01)

(58) Field of Classification Search

CPC ..... F01L 1/24; F01L 2001/2427; F01L 1/14; F01L 1/245; F01L 1/2405; F01L 2001/2444

(Continued)

(56) References Cited

U.S. PATENT DOCUMENTS 8,490,590 B2 * 7/2013 Kubota ..... F01L 1/185 123/90.45
2016/0238044 A1 8/2016 Xu

FOREIGN PATENT DOCUMENTS

CN 103939162 A 7/2014
JP 1993044411 A 2/1993

(Continued)

OTHER PUBLICATIONS

Written Opinion of the International Searching Authority mailed Mar. 17, 2015 in the corresponding application PCT/JP2014/082520.

*Primary Examiner* — Ching Chang
(74) *Attorney, Agent, or Firm* — Roberts Mlotkowski Safran Cole & Calderon P.C.

(57) ABSTRACT

A hydraulic lash adjuster having a reduced number of elements, yet capable of suppressing air from infusing into a high-pressure chamber. A plunger is fitted in a body. A reservoir is formed in the plunger. The plunger's head portion is formed with a communication hole for communicating its interior with its exterior. A high-pressure chamber is disposed and between the plunger and the body. An oil supply hole is formed in the peripheral wall of the plunger. A return spring is provided between the body and the plunger. A valve mechanism is provided at the plunger's bottom. Provided on the inner periphery of the plunger is an inclined area, subjected to impingement of oil jet ji and serving as an impingement area, such that the impingement area is inclined to fall in the direction of the ejected oil as the area nears the plunger's head portion.

3 Claims, 7 Drawing Sheets

(58) Field of Classification Search
USPC ..... 123/90.46, 90.55, 90.45, 90.52
See application file for complete search history.

(56) References Cited

FOREIGN PATENT DOCUMENTS

| | | | |
|---|---|---|---|
| JP | 1994146821 | A | 5/1994 |
| JP | 1994212917 | A | 8/1994 |
| JP | 1994299810 | A | 10/1994 |
| JP | 2006029423 | A | 2/2006 |
| JP | 2000508401 | A | 7/2007 |
| JP | 4159605 | B2 | 7/2008 |
| JP | 2013189926 | A | 9/2013 |

* cited by examiner

HYDRAULIC LASH ADJUSTER

CROSS-REFERENCE TO RELATED APPLICATIONS

The present application is a U.S. National Phase of PCT/JP2014/082520 filed on Dec. 9, 2014. The disclosure of the PCT Application is hereby incorporated by reference into the present Application.

TECHNICAL FIELD OF THE INVENTION

This invention relates to a hydraulic lash adjuster.

BACKGROUND ART

An internal combustion engine like an automobile is provided with a camshaft driven by the engine in synchronism therewith, a cam fixedly secured to the camshaft, and a rocker arm disposed between the cam and a valve stein of an intake (or exhaust) valve rockably about a fulcrum provided by a hydraulic lash adjuster. In this case, a driving force of the camshaft is transmitted to the valve stem via the cam and the rocker arm to displace the valve stein to thereby close/open the intake/exhaust valve. The hydraulic lash adjuster is adapted to automatically regulate a valve clearance between the cam and the rocker arm in response to an (extension/retraction) operation of the lash adjuster.

Provided in such a hydraulic lash adjuster as described above is a hollow plunger slidably fitted in a bottomed cylindrical body with a plunger's head portion extending from an open end of the body, as disclosed in Patent Document 1. The plunger is provided in its hollow section with a low-pressure chamber for storing oil, a communication hole formed in the plunger's head portion for communication of the low-pressure chamber with its exterior, and a high-pressure chamber to be charged with oil and located between the bottom of the body and the bottom of the plunger in the body. Each of the peripheral walls of the plunger and the body has an oil supply hole constituting an oil supply passage to supply oil to the low-pressure chamber. A valve mechanism is provided at the bottom of the plunger adapted to open a valve by a restoring force of a biasing means disposed between the bottom of the body and the bottom of the plunger to thereby allow for a flow of oil from the low-pressure chamber to the high-pressure chamber when the plunger is push-moved by the biasing means.

Use of this hydraulic lash adjuster in a valve operating mechanism of an internal combustion engine makes it possible to rockably support the rocker arm on the plunger's head portion and generate a damping force when an input load from the rocker arm is received by a hydraulic pressure of the high-pressure chamber and the plunger is retracted. On the other hand, in a case where a valve clearance takes place, the plunger is extended (in the direction of extension) to annihilate the valve clearance.

It is noted that in such a hydraulic lash adjuster as stated above, oil pumped by an oil pump from an oil pan is supplied to the high-pressure chamber via an oil passage and the low-pressure chamber during operation of the engine. Meanwhile, air bubbles are sometimes taken into the oil on the way to the high-pressure chamber. If the air bubbles remain in the high-pressure chamber, they can be easily compressed by the retracting plunger, resulting in easy contraction of the plunger which impedes a basic function of the plunger to generate a damping force.

For this reason, in recent years in order to prevent air bubble from infusing into the high-pressure chamber, a proposition has been made to provide in the plunger a guide cylinder for guiding the oil that flows from the oil supply passage into the plunger to the plunger's head portion via a space between the outer periphery of the guide cylinder and the inner periphery of the plunger, as disclosed in Patent Document 2. Specifically the guide cylinder is formed with a portion having at its leading end a smaller outer diameter than that of a base section of the guide cylinder. The leading end of the guide cylinder is oriented towards the plunger's head portion and the outer periphery of the base section of the guide cylinder is engaged with an inner periphery portion of the plunger nearer to the plunger bottom than to the oil supply passage, thereby forming an annular space between the inner periphery of the plunger and the outer periphery of the guide cylinder at a position nearer to the plunger's head portion than to the oil supply passage. Thus, during operation of the engine, the oil supplied from the oil supply passage is first guided towards the plunger's head portion through the annular space, where air bubbles are gradually separated from the oil (growth of air bubbles). While the oil itself flows back to the high-pressure chamber via the guide cylinder when the valve is opened by the valve mechanism, the separated air is discharged out of the plunger from the communication hole of the plunger's head portion together with surplus oil.

PRIOR ART DOCUMENTS

Patent Documents

Patent Document 1 JPA 2013-189926.
Patent Document 2 JP 4259605

BRIEF DESCRIPTION OF THE INVENTION

Objects to be Achieved by the Invention

In the above mentioned hydraulic adjuster, however, in order to suppress infusion of air into its high-pressure chamber, it is necessary to provide a new guide cylinder in the plunger to form the annular space saving as an oil guide passage between the outer periphery of the guide cylinder and the inner periphery of the plunger, which inevitably requires an additional number of parts for the lash adjuster.

In view of such problems pertinent to the prior art hydraulic lash adjuster, it is an object of the present invention to provide a hydraulic lash adjuster that has a reduced number of parts, yet capable of suppressing infusion of air into the high-pressure chamber.

Means of Achieving the Object

To achieve the object above, there is provided, a hydraulic lash adjuster comprising:

- a hollow plunger slidably fitted in a bottomed cylindrical body, with its head portion protruding from an open end of the body;
- a low-pressure chamber for storing oil therein, the low-pressure chamber formed in the plunger utilizing an interior of the plunger and in communication with an exterior and an exterior thereof via a communication hole formed in the head portion,
- a high-pressure chamber to be charged with oil, the high-pressure chamber formed between a bottom of the body and a bottom of the plunger in the body;

an oil supply hole, formed in a peripheral wall of the plunger, for ejecting oil into the low-pressure chamber and for constituting an oil supply passage;

a biasing means disposed between the bottom of the body and the bottom of the plunger; and a valve mechanism disposed at the bottom of the plunger and adapted to open a valve to allow for a flow of oil from the low-pressure chamber to the high-pressure chamber when the plunger is extended by a restoring force of the biasing means, the lash adjuster characterized in that an impingement area of the inner periphery of the plunger subjected to impingement of oil ejected from the oil supply hole is inclined to fall in the direction of the ejected oil as the area nears the plunger's head portion. Preferred modes of the hydraulic lash adjuster are recited hereinafter.

Effects of the Invention

Since an impingement area of the inner periphery of the plunger subjected to impingement of oil ejected from an oil supply hole is inclined such that a portion of the impingement area nearer to the plunger's head portion is more inclined to fall in the direction of the ejected oil, the direction of the flow of oil ejected from the oil supply hole into the low-pressure chamber is changed upon impingement on the impingement area, and the flow is mostly re-directed towards the plunger's head portion away from the high-pressure chamber, but not to the high-pressure chamber. Consequently, the air bubbles, if contained in the oil, are led to the plunger's head portion, where oil pressure (static pressure) around the air bubbles is reduced and aggregation and unification of air bubbles are promoted on the inner periphery of the plunger's head portion, so that volumes of air bubbles increase (and so do buoyant forces) and migration of the air bubbles from the plunger's head portion to the bottom of the plunger is suppressed. The bubbles in the plunger's head portion are discharged therefrom to the exterior of the plunger together with surplus oil through the communication hole. As a consequence, in the inventive hydraulic lash adjuster, it is possible to easily suppress infusion of air into the high-pressure chamber without using any guide cylinder in the plunger and utilizing a reduced number of parts.

Furthermore, since the oil ejected from the oil supply hole into the low-pressure chamber impinges on the impingement area of the inner periphery of the plunger, air bubbles in the oil are prompted to integrate to still larger bubbles (as assisted by increased buoyant forces acting on their larger volumes), which facilitates aggregation of air bubbles in the plunger's head portion.

The plunger is provided on its inner periphery with a pair of inclined areas opposing each other across an inner diameter of the plunger;

the pair of inclined areas come closer to each other as they extend away from the plunger's head portion in the axial direction of the plunger;

the oil supply hole is formed in one of the paired inclined areas with its opening facing an interior of the low-pressure chamber; and the oil supply hole is so set as to direct the orientation of the oil supply hole to the other inclined area of the paired inclined areas so that the other inclined area serves as the impingement area, most of the oil ejected from the oil supply hole into the low-pressure chamber is directed towards the plunger's head portion after it has impinged on the other inclined area. Accordingly, infusion of air into the high-pressure chamber can be suppressed in a specific way while reducing the number of parts required for the plunger.

Further, since the pair of inclined areas are inclined to come closer to each other as they extend away from the plunger's head portion in the axial direction of the plunger, and since the oil supply hole formed in one of the paired inclined areas is oriented to the other inclined area, the distance for the oil ejected from the oil supply hole to reach the other inclined area can be shortened as compared with a case where such paired inclined areas are not formed, so that the oil ejected from the oil supply hole can impinge on the other inclined area at a high ejection speed. As a result, the oil retains its high speed even after the impingement, and flows towards the plunger's head portion, thereby causing most of the oil to be delivered to the plunger's head portion and facilitating aggregation and integration of air bubbles in the plunger's head portion and promoting discharge of air bubbles. Consequently, infusion of air into the high-pressure chamber can be well suppressed.

Since the oil supply hole is provided in a region, most proximal to the bottom of the plunger, of said one inclined area, the distance for the oil ejected from the oil supply hole to reach the other inclined area is minimized, thereby it is possible to cause the oil ejected from the oil supply hole to impinge on the other inner inclined peripheral portion at a maximum ejection speed, and allow most of the ejected oil to reach the plunger's head portion after the impingement at that high ejection speed. On the other hand, since the pair of inclined areas are arranged at an axial position of the plunger closer to the bottom of the plunger than to the plunger's head portion, the distance from the pair of the inclined areas to the plunger's head portion can be increased to enhance chances of aggregation and integration of air bubbles in that relatively long passage. Consequently, due to the fact that chances of aggregation and integration of air bubbles are increased in the passage to the plunger's head portion, air bubbles can be collected in the plunger's head portion in aggregated and integrated conditions, thereby further facilitating suppression of air infusion into the high-pressure chamber.

The plunger is provided on the inner periphery thereof with a pair of inclined areas that oppose each other across an inner diameter of the plunger;

the pair of inclined areas are inclined to come closer to each other as they extends away from the plunger's head portion in the axial direction of the plunger;

an oil supply hole is formed in one of the paired inclined areas with its opening facing an interior of the low-pressure chamber; and the plunger is provided, on a region of the other inclined area closer to the plunger's head portion, with a planar area contiguous to the other inclined area and extending in parallel to the axis of the plunger; and the oil supply hole is so set as to direct the orientation of oil supply hole to the planar area so that the planar area serves as the impingement area. Consequently, the oil ejected from the oil supply hole into the low-pressure chamber is re-directed to the plunger's head portion after its impingement on the planar area. As a result, in one mode of the invention infusion of air into the high-pressure chamber can be easily suppressed while reducing the number of components constituting the plunger.

Further, since the oil supply hole oriented to the planar area is formed on one inclined area, the axis of the oil supply hole can be directed in an orientation close to a thick-wall direction of the bulge portion of said one inclined area, so that the oil supply hole can be easily fabricated in the plunger and durability of fabrication tools is improved.

The plunger is provided entirely along an inner circumference of its peripheral wall with a bulge portion that bulges radially inwardly in the plunger;

the plunger is provided on its inner periphery with diametrically contracting inclined periphery region utilizing the bulge portion such that the inclined periphery region has a contracting inner diameter that decreases as the region extends in the axial direction of the plunger away from the head portion of the plunger;

each of the paired inclined areas is formed by utilizing a portion of the inclined peripheral region; and an oil introducing hole that constitutes the oil supply passage and facing an interior of the bulge portion is formed in the peripheral wall of the body, so that the oil introducing hole of the body overlaps the interior of the bulge portion of the plunger if the plunger is a little rotated about, or moved in, the axial direction with respect to the body and that the oil introducing hole of the body and the oil supply hole of the plunger can be always communicated with each other, thereby enabling uninterrupted oil supply to the plunger during operation of the engine. On the other hand, by utilizing the inclined periphery region of the bulge portion and a portion of the plunger's inner periphery closer to the plunger's head portion than to the inclined periphery region, the oil ejected from the oil supply hole can be re-directed to the plunger's head portion, although the head portion is located far away from the high-pressure chamber. Thus, the paired inclined areas, the planar area, and the oil supply hole can be formed by effective utilization of the bulge portion formed to communicate the oil supply hole of the plunger with the oil introducing hole of the body, which leads to structural simplification of, and reduction in manufacturing work for, a hydraulic lash adjuster.

In addition, since the inclined periphery region is formed utilizing the bulge portion, the inclined periphery region can be formed easily in a process of roll forming a plunger.

BEST MODE FOR CARRYING OUT THE INVENTION

The invention will no be described in detail by way of example with reference to the accompanying drawings.

Figure 1:
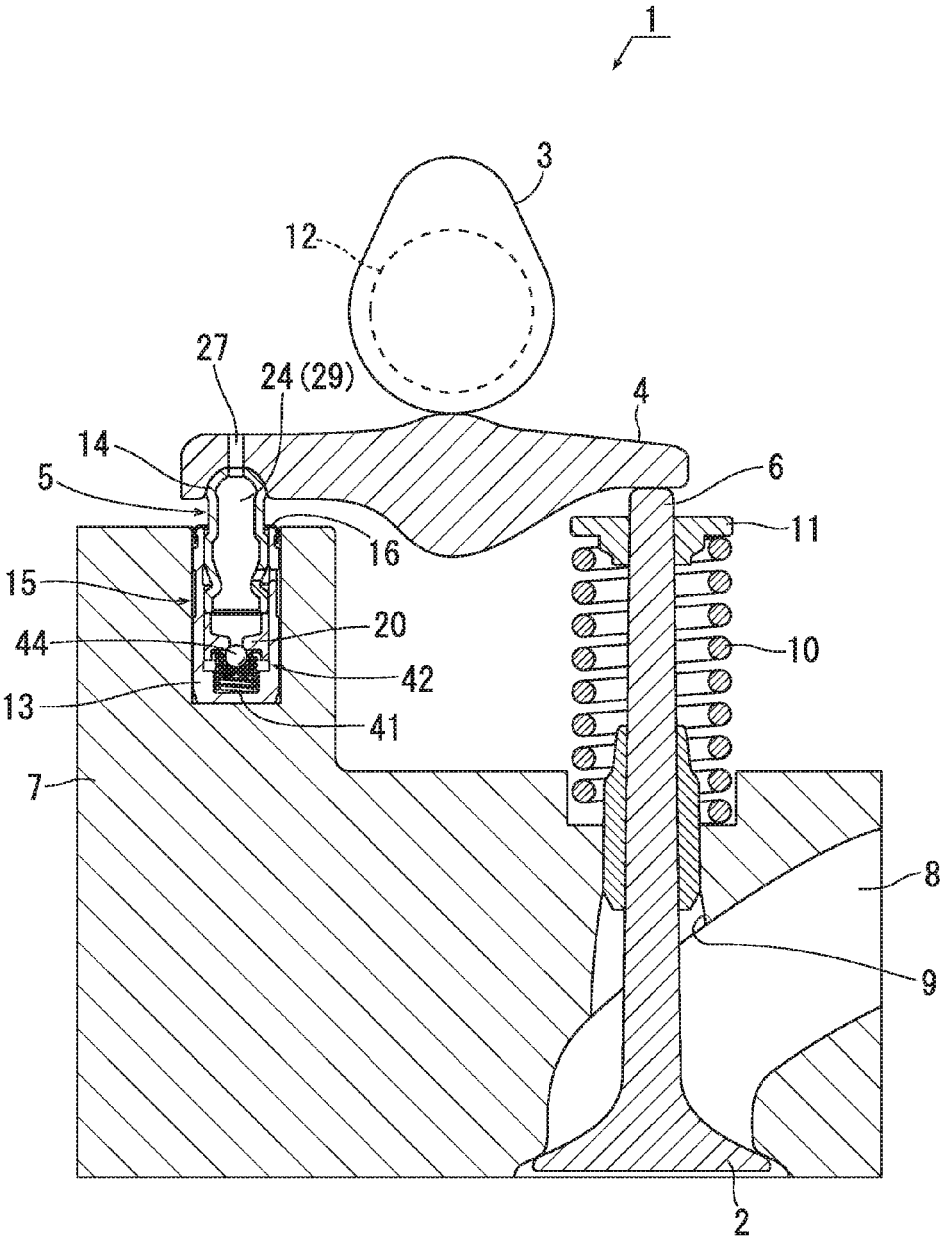
FIG. 1 is a longitudinal cross section of a valve operating mechanism having a hydraulic lash adjuster of a first embodiment according to the invention.

FIG. 1 shows a valve operating mechanism 1 of an internal combustion engine. The valve operating mechanism 1 for opening/closing an intake (or exhaust) port 8 communicated with a combustion chamber comprises an intake (or exhaust) valve 2 (hereinafter simply referred to as valve 2) for opening/closing the port 8, a rotatably driven cam 3, a rocker arm 4 provided between the intake (exhaust) valve 2 and the cam 3 to transmit a rotational driving power of the cam 3 to the valve, and a hydraulic lash adjuster 5 supporting the rocker arm 4 at a fulcrum point provided by the lash adjuster 5.

As is well known, the valve 2 has an integral valve stem 6, which is slidably inserted in a through-hole 9 communicated with the intake/exhaust port 8 formed in an cylinder head 7 of an engine. A compression coil spring 10 is loosely mounted on the periphery of the valve stem 6 and between the cylinder head 7 and a retainer 11 securely fixed at an upper position of the valve stem 6, urging the valve 2 so as to open/close the intake (exhaust) port 8.

The cam 3 is firmly secured on the camshaft 12, which is synchronously driven by the engine, so that the cam 3 is also rotatably driven by the rotating camshaft 12.

The rocker arm 4, set in a rocking motion by the rotating cam 3 by rotational driving power of the cam 3, transmits the driving power to the valve stem 6, thereby putting the valve stem 6 in reciprocal motion in the through-hole 9 in response to rocking motions of the rocker arm 4. The valve 2 in turn opens/closes the intake (exhaust) port 8 in response to the reciprocal motion of the valve stem 6.

Figure 2:
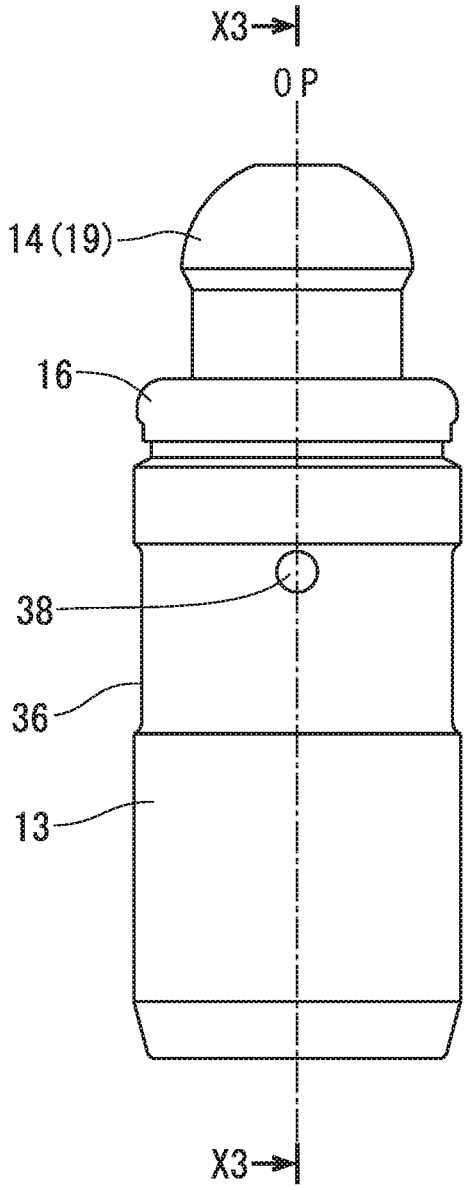
FIG. 2 is a front view of the hydraulic lash adjuster of the first embodiment.
Figure 3:
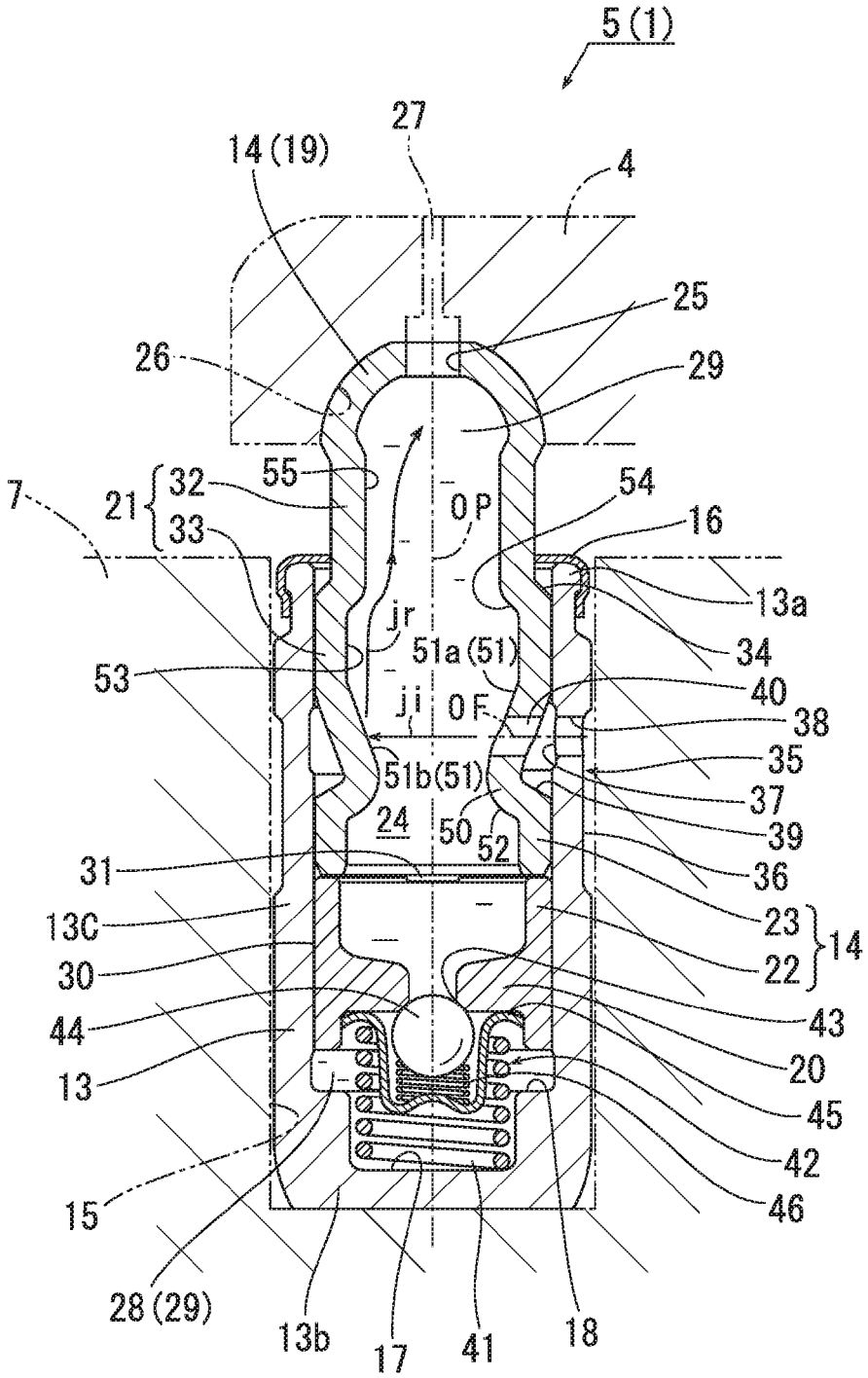
FIG. 3 is cross section of the lash adjuster taken along line X3-X3 of FIG. 2.
Figure 4:
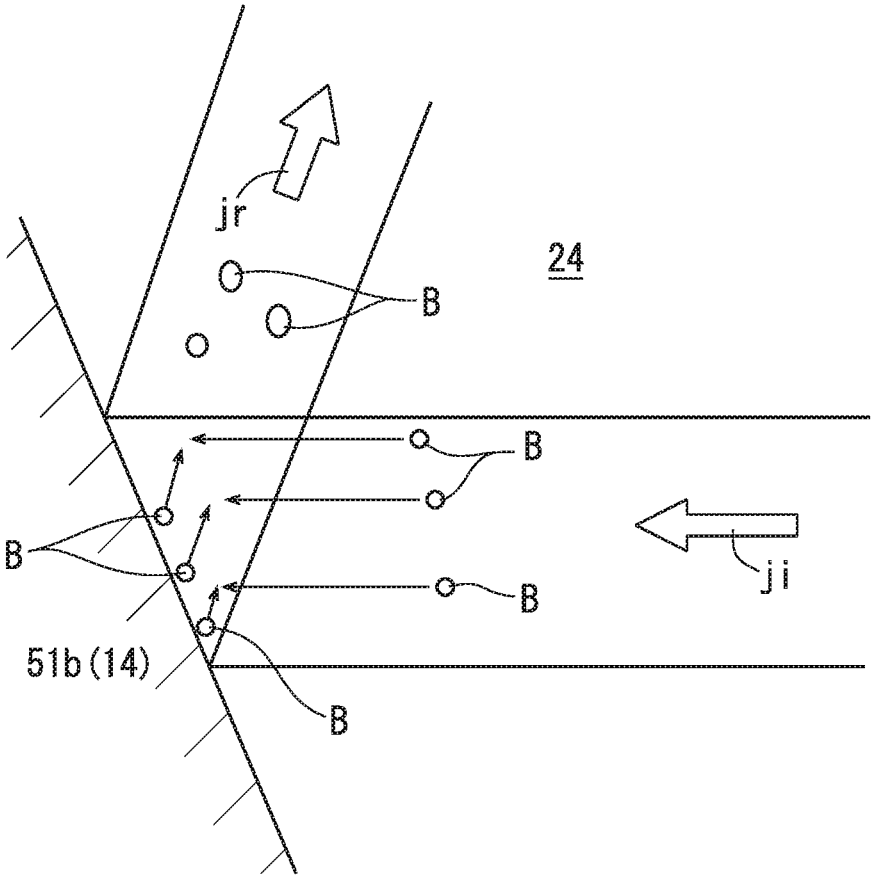
FIG. 4 shows functions of the hydraulic lash adjuster of the first embodiment.

The hydraulic lash adjuster 5 has a plunger 14 slidably fitted in a bottomed body 13, as shown in FIGS. 1 through 3, so as to rockably support the rocker arm 4 in engagement with the fulcrum.

The body 13 has a shape of a bottomed cylinder secured in a circular recess 15 formed in an upper end of the cylinder head 7, with its opening held upward. The body 13 is formed on its upper periphery with a diametrically small portion 13*a* having a smaller outer diameter than the rest thereof. Mounted on the diametrically small portion 13*a* is an annular retainer cap 16 for preventing the plunger 14 from coming off the body 13. A recess 17 is formed in the inner periphery of a bottom portion 13*b* of the body 13, and formed in between an inner periphery of the recess 17 and an inner periphery of the peripheral wall 13*c* of the body 13 (closer to the opening than to the bottom portion 13*b*) is an annular step 18.

The plunger 14 is a generally hollow rod member. This plunger 14 has at one end thereof a coaxial head portion 19, a bottom portion 20 at the other end, and a peripheral wall 21 spanning the head portion 19 and the bottom portion 20. The head portion 19 of the plunger 14 extends out of the opening of the body 13 with its body-side portion adjacent the bottom 20 is slidably fitted in the body 13.

In this embodiment, the plunger 14 has a two-piece structure, consisting of a bottom-side plunger portion 22 and a head-side plunger portion 23, as shown in FIG. 3.

The bottom-side plunger portion 22 constitutes a bottom-side portion of the plunger 14 and has a shape of a generally hollow bottomed cylinder placed in the body 13, wherein the bottom of the bottom-side plunger portion 22 serves as the bottom 20 of the plunger 14 facing the bottom portion 13*b* of the body 13, with an open end of the bottom-side plunger portion 22 oriented towards the opening of the body 13.

The head-side plunger portion 23 has a shape of a generally bottomed cylinder and constitutes a head-side portion of the plunger 14 closer to the head portion of the plunger 14 than the bottom-side plunger portion 22. The head-side plunger portion 23 has a bottom (of the bottomed cylinder) which serves as the head portion 19 of the plunger 14 and is oriented (upward) towards the opening of the body 13, while an open end of the head-side plunger portion 23 is placed on the open end of the bottom-side plunger portion 22 within the body 13. Thus, the inner spaces of the bottom-side plunger portion 22 and the head-side plunger portion 23 cooperate to constitute a reservoir 24, saving as a low-pressure chamber, for storing oil therein.

The head portion 19 of the plunger 14 (the head-side plunger portion 23) is configured in a shape of bulging semi-sphere, as shown in FIGS. 1 and 3, and a communication hole 25 for communicating the interior and the exterior of the plunger 14 is formed in the head portion 19. In association with this semi-spherical head portion 19, the rocker arm 4 is provided with a substantially semi-spherical recess 26 formed in its surface abutting against the plunger 14, and with a communication hole 27 for communicating the interior and the exterior of the recess 26. The head portion 19 of the plunger 14 functions as a fulcrum supporting the recess 26 of the rocker arm 4.

The bottom portion 20 of the plunger 14 defines a high-pressure chamber 28 in the body 13, as shown in FIG. 3. The high-pressure chamber 28 is filled with oil 29 such that, when an input load is inputted by the rocker arm 4 into the plunger's head portion 19, the input load is received by the oil in the high-pressure chamber 28. Meanwhile, the oil 29 in the high-pressure chamber 28 leaks into a minute gap 30 between the outer periphery of the peripheral wall 13*c* of the plunger 14 (bottom-side plunger portion 22) and the inner periphery of the circumferential wall 21 of the body 13, which oil is returned back to the reservoir 24 (inside the plunger 14) from those separating surfaces of the head-side plunger portion 23 and the bottom-side plunger portion 22, in order to facilitate smooth return of the leaking oil from the minute space 30 to the plunger 14, an oil returning passage 31 is provided between the bottom-side plunger portion 22 and the head-side plunger portion 23 and in communication with the minute space 30 and the reservoir 24.

As shown in FIG. 3, the peripheral wall 21 of the plunger 14 has a head-side peripheral wall 32 (consisting of a part of the head-side plunger portion 23) contiguous to the head portion 19 of the plunger 14, and a main peripheral wail 33 (consisting of a part of the head-side plunger portion 23 and the bottom-side plunger portion 22) adjacent the bottom portion 20 of the plunger 14, not adjacent the head-side peripheral wall 32. The outer diameter of the head-side peripheral wall 32 is smaller than that of the main peripheral wall 33, thereby forming a step 34 between the outer periphery of the head-side peripheral wall 32 and the outer periphery of the main peripheral wall 33, the step 34 facing the retainer cap 16 in the body 13 to prevent the plunger 14.

As shown in FIG. 3, each of the peripheral walls 13*c* and 21 of the body 13 and the plunger 14, respectively is formed with an oil supply passage 35 for supplying oil pumped from an oil pan (not shown) to the reservoir 24, in the embodiment shown herein, the oil supply passage 35 consists of annular grooves 36 and 37 each formed in the outer and inner peripheries, respectively, of the peripheral wall 13*c* of the body, an oil supply hole 38 spanning the annular grooves 36 and 37 to serve as an oil introducing hole, an annular groove 39 formed in the outer periphery of the peripheral wall 21 of the plunger 14 and at substantial center of the axis OP of the plunger 14, and an oil supply hole 40 spanning the annular groove 39 and the reservoir 24, wherein these holes and grooves are kept in communication with each other during operation of the engine to eject externally supplied oil into the reservoir 24 via the oil supply passage 35.

In this embodiment, an annular bulge portion 50 is formed to form an annular groove 39 of the plunger 14 by allowing the peripheral wall 21 (head-side plunger portion 23) of the plunger 14 to bulge in the radially inward direction of the plunger 14 as shown in FIG. 3. The bulge portion 50 is formed in a rolling process, for example, to extend entirely over a circumference of the peripheral wall 21 of the plunger 14, so that the annular groove 39 is provided by the bulge portion 50 round the outer periphery of the plunger 14. The width of this annular groove 39 (as measured in the direction of the axis OP of the plunger 14) has a relatively long in that it is longer than that of the wide annular groove 37 formed in the body 13. Since these annular grooves 39 and 37 overlap each other, the oil supply hole 38 always remain to face the annular groove 39 of the body 13 even when the plunger 14 is slightly rotated and/or extended/retracted to a certain degree relative to the body 13.

Consequently as the oil pumped from an oil pan (not shown) by an oil pump is supplied to the wide annular grooves 36 formed in the outer periphery of the peripheral wall 13*c* via an oil pass (not shown) of the cylinder head 7, the oil is supplied to the annular groove 37 via, the oil supply hole 38 during operation of the engine. The oil supplied to the annular groove 37 is supplied further to the annular groove 39 formed in the outer periphery of the peripheral wall 21 of the plunger 14 and then to the reservoir 24 via the oil supply hole 40 formed in the peripheral wall 21 of the plunger. In this way the reservoir 24 is charged with oil during operation of the engine, and its surplus oil supplied thereinto is ejected out of the reservoir 24 from the communication hole 25 of the plunger's head portion 19. Meanwhile, the ejected oil provides lubrication to the rocker arm 4 for example.

As shown in FIG. 3, taking advantage of its radially inward bulging configuration, the annular bulge portion 50 provides the inner periphery of the plunger 14 with a first inclined periphery region 51 and a second inclined periphery region 52 that is located at a position remote from the first inclined periphery region 51 with reference to the plunger's head portion 19.

The first inclined periphery region 51 is configured to have a contracting inner diameter that decreases as it extends away from the plunger's head portion 19 in the direction of the axis OP of the plunger 14, while the second inclined periphery region 52 is configured such that the inner diameter of the plunger 14 increases as the inclined periphery region 52 extends continuously from the first inclined periphery region 51 and away from the plunger's head portion 19. The first inclined periphery region 51 rises radially inwardly at a gentle inclination angle than the second inclined periphery region 52. Accordingly, the first inclined periphery region 51 is longer in the direction of the axis OP of the plunger 14 than the second inclined periphery region 52.

An opening of the oil supply hole 40 is provided in an inclined area 51*a* (one of inclined areas) which occupies a part of the first inclined periphery region 51 as shown in FIG. 3. In the embodiment, shown herein, the orientation of the oil supply hole 40 is directed in the radially inward direction of of the plunger 14 such that the axis OF of the oil supply hole 40 and the axis OP of the plunger 14 are perpendicular to each other. Accordingly, an oil jet ji ejected from the oil supply hole 40 into the low-pressure chamber 24 impinges on an inclined area 51*b* (the other inclined area, impinging area) of the first inclined periphery region 51, which opposes the inclined area 51*a* of the first periphery region 51), as shown in FIG. 3. Owing to the configuration of the first inclined peripheral region 51, the inclined area 51*b* is more inclined to fall in the direction of the ejected oil as the inclined area 51*b* extends towards the plunger's head portion 19 (to the left in FIG. 3). The inclination angle is so set as to change most of the oil jet ji to re-directed oil jet jr directed to the plunger's head portion 19 after the oil jet ji has impinged on the inclined area 51*b* (See FIG. 3).

As shown in FIG. 3, there are formed on the inner periphery of the plunger 14, in correspondence with the outer circumferential configuration of the head-side peripheral wall 32 and the main peripheral wall 33, a base inner periphery portion 53, an inclined periphery region 54, and a radially contracting inner periphery portion 55 in the order mentioned in the direction away from the first inclined periphery region 51 towards the plunger's head portion 19. The base inner periphery portion 53 is contiguous with the first inclined periphery region 51, extends in the direction of the axis OP of the plunger 14, and faces in a radially inward direction. The base inner periphery portion 53 constitutes a base inner periphery (inner diameter) of the main peripheral wall 32. The inclined periphery region 54 is configured to be contiguous with the base inner periphery portion 53 and have a contracting inner diameter that decreases as the portion extends towards the plunger's head portion 19. The radially contracting inner periphery portion 55 is contiguous with the inclined periphery region 54 and has the same inner diameter as the smallest inner diameter of the inclined periphery region 54, to thereby constitute the base inner periphery (inner diameter) of the head-side peripheral wall 32.

As shown in FIG. 3, a return spring 41, serving as a biasing means, is provided between the bottom portion 13*b* of the body 13 and the bottom portion 20 (bottom of the recess 17) of the plunger 14. The return spring 41 is compressed by a retraction of the plunger 14 relative to the body 13, and then retains a restoring force (repulsive three) in response to the compression.

The plunger 14 is further provided, at the bottom portion 20 thereof adjacent the high-pressure chamber 28, with a valve mechanism 42 as shown in FIG. 3. This valve mechanism 42 is provided at a concentric position of the bottom portion 20 with a valve hole 43 for allowing oil to flow from the reservoir 24 to the high-pressure chamber 28, a check ball 44 disposed in the high-pressure chamber 28 in opposition to the valve hole 43, a retainer 45 pressed by the return spring 41 against the bottom portion 20, and a check-ball spring 46, disposed between the retainer 45 and the check ball 44, for biasing the check ball 44 in a direction for seating the check ball 44 on a peripheral edge of the valve hole 43. Consequently, the valve mechanism 42 is closed by the check ball 44 when the plunger 14 is retracted relative to the body 13, and opened to allow for oil to flow from the reservoir 24 to the high-pressure chamber 28 when the plunger 14 is moved to extend relative to the body 13, causing the check ball 44 to be separated from the peripheral edge of the valve hole 43.

In such a valve operating mechanism 42 shown above, an oil pump supplies oil from the oil pan to the reservoir 24 of the plunger 14 (hydraulic lash adjuster 5) via an oil passage (not shown) and the oil supply passage 35 following a start up of the engine, thereby charging the reservoir 24 with oil 29, while surplus oil is discharged out via the communication hole 25 of the plunger's head portion 19 and a communication path 27 of the rocker arm 4.

Meanwhile, when the rocker arm 4 is swung by the cam 3 in rotation lowering its action point, the valve stem 6 is displaced to open the valve 2, the rocker arm 4 tends to warp under a resilient force of the compressed coil spring 10, which in turn causes the plunger 14 to be pressed down by the rocker arm 4. Accordingly, the pressure of the oil 29 in the high-pressure chamber 28 is increased, rendering the oil 29 rigid and allowing the lash adjuster 24 to serve as a fulcrum of the rocker arm 4. Meanwhile, the plunger 14 gradually lowers itself while leaking oil by degrees into the minute space 30 between the plunger 14 and the body 13.

As the cam 3 is further rotated under this condition, the rocker arm 4 further displaces the valve stem 6 to open the valve 2, the valve 2 is opened to open the intake port (or exhaust port) 8, thereby communicating the intake port (or exhaust port) via the intake passage (or exhaust passage) 8.

On the other hand, as the cam 3 is further rotated after the intake (exhaust) port 8 is opened, the valve stem 6 is displaced by the resilient force of the compression coil spring 10 to close the valve 2, rendering the rocker arm 4 rocked to lift its action point so that the intake (exhaust) port 8 is closed by the valve 2.

As the cam 3 is rotated further, the reactive resilient force of the compression coil spring 10 disappears, leaving a gap between the rocker arm 4 and the cam 3. Consequently, the plunger 14 is allowed to extend upward by a distance that amounts to the gap under the biasing force of the return spring 41 provided in the hydraulic lash adjuster 5. Under this condition, a negative pressure is generated in the high-pressure chamber 28, so that the check ball 44 is pushed down against the biasing force of the spring 46, causing the oil to flow from the reservoir 24 into the high-pressure chamber 28 until the pressures in the high-pressure chamber 28 and the pressure in the reservoir 24 is balanced out, when the valve hole 43 is closed by the check ball 44 (standby condition).

In this way, in response to the rotation of the cam 3 driven by the engine, the rocker arm 4 is rocked about the fulcrum defined by the hydraulic lash adjuster 5 (plunger 14), and the valve stem 6 either descends or ascends in accord with the rocking motion of the rocker arm 4 to thereby open or close the intake (exhaust) port 8.

In view of the fact that the air in the high-pressure chamber 28 can be easily compressed by the retracting plunger 14 and impede the damping function of the plunger 14, it is noted that the hydraulic lash adjuster 5 of this valve operating mechanism 1 is configured to suppress infusion into the high-pressure chamber 28 of air (bubbles) contained in the oil supplied to the reservoir 24.

In other words, since the orientation of the oil supply hole 40 formed in the plunger 14 is directed to the inclined area 51*b* (of the first inclined periphery region 51) that lies in opposition to the oil supply hole 40, the oil jet ji, when ejected from the oil supply hole 40 into the low-pressure chamber 24, will impinge on the inclined area 51*b* of the first inclined periphery region 51, and owing to the impingement, most of the oil jet ji will change into a re-directed oil stream jr directed to the plunger's head portion 19, as shown in FIG. 3.

Consequently, as the re-directed oil stream jr reaches the plunger's head portion 19, air hubbies in the stream jr aggregate and get integrated by a substantially semi-spherical inner surface of the plunger's head portion 19 and grow still larger, so that their movement from the plunger's head portion 19 to the bottom portion 20 of the plunger is suppressed by increased buoyant forces. On the other hand, these air bubbles in the plunger's head portion 19 are discharged out from the communication hole 25 of the plunger's head portion 19 together with its surplus oil as oil is supplied to the reservoir 24.

Figure 5:
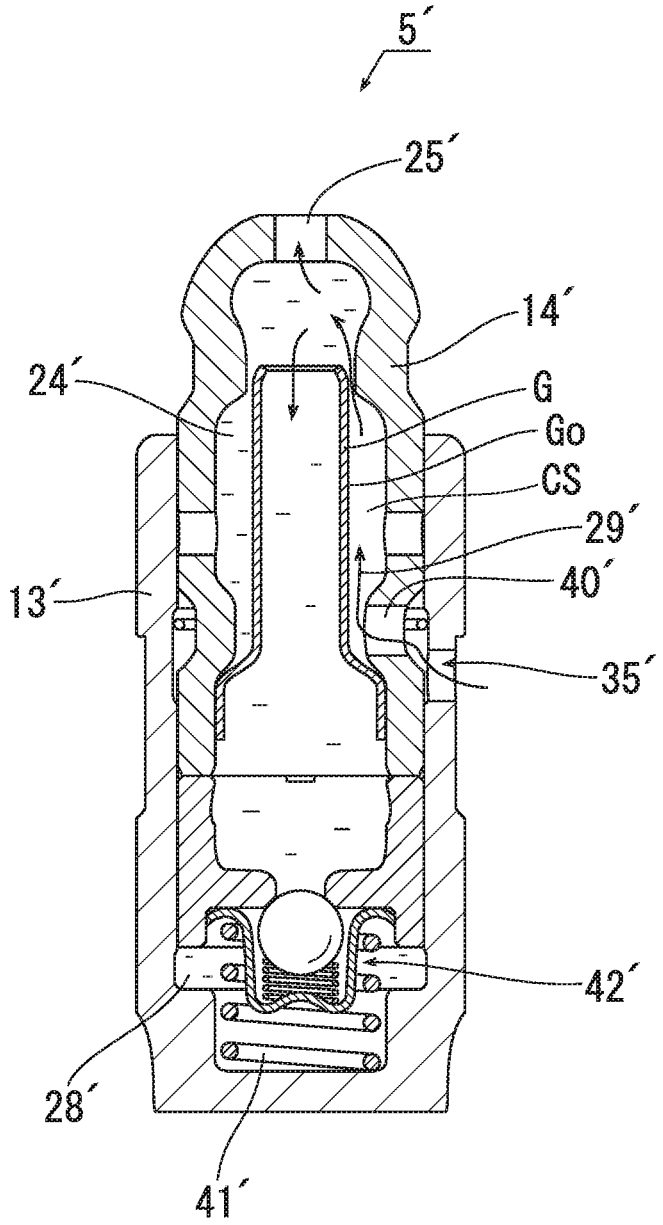
FIG. 5 is a longitudinal cross section of a conventional hydraulic lash adjuster.

In this manner, it is possible to suppress infusion of air bubbles into the high-pressure chamber 28 by re-directing the oil jet ji ejected into the reservoir 24 to the plunger's head portion 19 located away from the high-pressure chamber 28 by means of the inclined area 51*b* of the first inclined periphery region 51. Thus, it is not necessary in the present invention to provide such a guide cylinder G as used in a conventional structure illustrated in FIG. 5 where the guide cylinder G is provided in a plunger 14' to supply oil 29' from the oil supply hole 40' thereinto such that oil 29' is guided from an oil supply hole 40' to the head portion 19' of the plunger 14' via an annular space CS between the outer periphery Go of the guide cylinder G and the inner periphery of the plunger 14'. It is noted that in a conventional structure shown in FIG. 5 each of elements having the same or like structures as corresponding elements of the present embodiment is denoted by the same but primed reference numeral.

In addition, since the oil jet ji ejected from the oil supply hole 40 into the reservoir 24 impinges on the inclined area 51*b* of the inner periphery of the plunger 14, the collision facilitates air bubbles B in the oil jet ji and air bubbles B in the re-directed stream jr to collide with each other and get integrated to grow into still larger air bubbles (accompanying increased buoyant forces due to increase in volume). This helps air bubbles in oil to gather in the plunger's head portion 19.

It is noted in the embodiment shown herein that the inclined periphery region 54 is provided in a region of the inner periphery of the plunger 14 closer to the plunger's head portion 19 than to the base inner periphery portion 53, so that, after the oil jet ji is changed into the re-directed stream jr towards the plunger's head portion 19 by the inclined area 51*b* of the first periphery region 51, the stream is guided by the inclined periphery region 54 radially inwardly in the plunger 14. As a consequence, the re-directed stream jr basically flows towards the plunger's head portion 19 while flowing radially inwardly in the plunger 14, so that a major (or central) portion of the re-directed stream jr is separated away from the inner periphery of the plunger 14 as much as possible. This suppresses reversion in direction of the re-directed stream jr by the substantially semi-spherical inner surface (particularly its substantially semi-spherical portion) of the plunger's head portion 19 and streaming of the reversed stream to the bottom portion 20 of the plunger.

Furthermore, since both of the inclined area 51*a* having the oil supply hole 40 and the inclined area 51*b* serving as the oil impinging area for the oil jet ji from the oil supply hole 40 each occupy respective portions of the first inclined periphery region 51, and since the distance between the inclined areas 51*a* and 51*b* is shorter than the inner diameter of the base inner periphery portion 53, the oil jet ji ejected from the oil supply hole 40 impinges on the inclined area 51*b* at a high oil ejection speed. Consequently, the resultant re-directed oil stream jr also flows towards the plunger's head portion 19 at a high speed, allowing most of the re-directed oil stream jr to reach the plunger's head portion 19. As a result, much of the air bubbles in the stream aggregate and get integrated by the substantially semi-spherical inner surface of the head portion 19, and discharge of the air bubbles is promoted.

Figure 6:
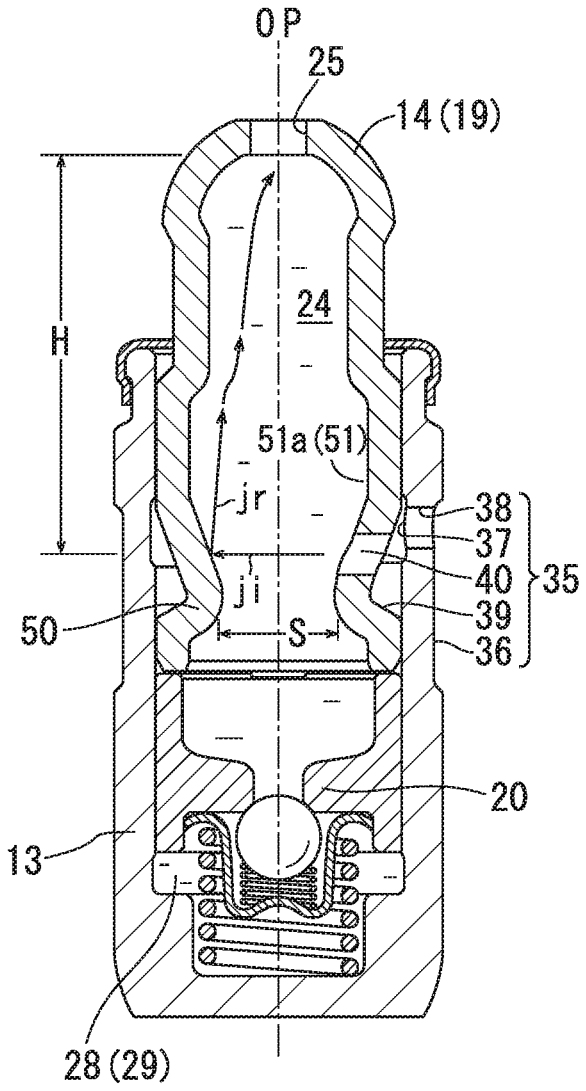
FIG. 6 is a longitudinal cross section of a hydraulic lash adjuster of a second embodiment according to the invention.
Figure 7:
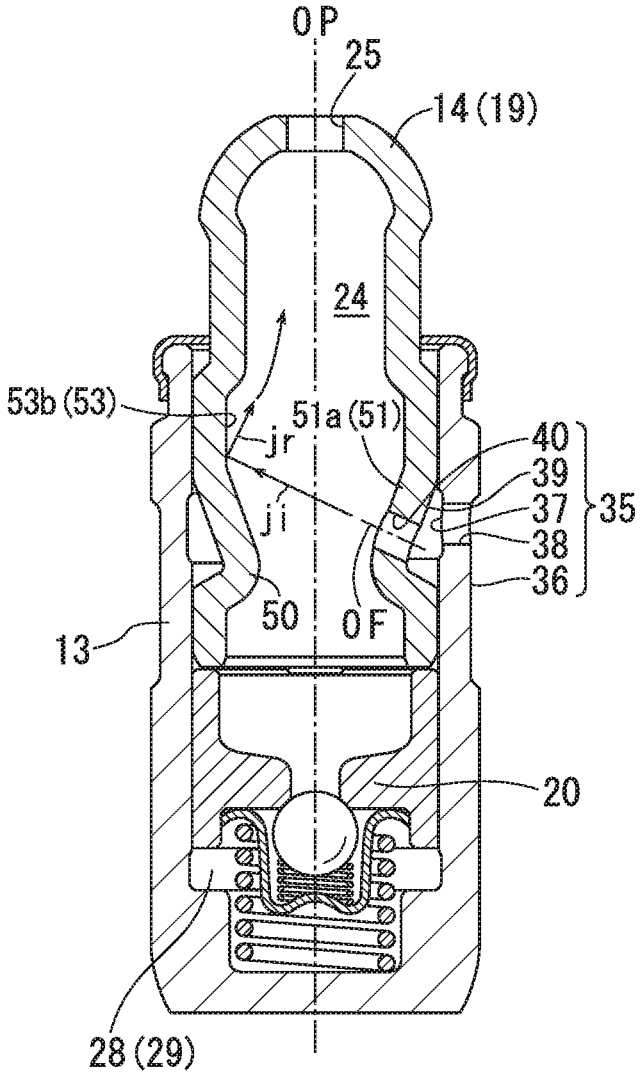
FIG. 7 is a longitudinal cross section of a third embodiment according to the invention.

FIG. 6 and FIG. 7 show a second and a third embodiments, respectively, according to the invention. The same reference numerals will be used to denote the same elements in these embodiments as well as in the first embodiment, and further descriptions thereof will be omitted.

The second embodiment shown in FIG. 6 is a modification of the first embodiment. In this second embodiment, the oil supply hole 40 is formed in a region of one inclined area 51*a* most proximal to the bottom portion 20 such that the distance S from the oil supply hole 40 to the other inclined area 51*b* is the shortest among cases where the oil supply hole 40 is formed in said one inclined area 51*a*. Consequently, the oil jet ji ejected from the oil supply hole 40 is allowed to impinge on the other inclined area 51*b* at the highest ejection speed, and hence, owing to the high ejection speed, the re-directed stream of oil jr can be well delivered to the plunger's head portion 20.

In addition, as compared with the first embodiment, a pair of inclined areas 51*a* and 51*b* of the second embodiment are disposed closer to the bottom portion 20 in the direction of the axis OP of the plunger 14 than to the plunger's head portion 19, so that the distance H from the paired inclined areas 51*a* and 51*b* to the plunger's head portion 19 is longer than that of the first embodiment. (See FIG. 3)

Consequently, in the second embodiment, air bubbles has enhanced chances to aggregate and get integrated in a stream away from the high-pressure chamber 28 while streaming over a relatively long distance to the plunger's head portion 19.

FIG. 7 shows a third embodiment according to the invention, which is a further modification of the first embodiment. In the third embodiment, the oil supply hole 40 is formed such that the axis OF of the oil supply hole 40 is substantially perpendicular to the first inclined periphery region 51 (inclined area 51*a*), so that the orientation of the oil supply hole 40 is directed to a portion (planar area) 53*b* of the base inner periphery portion 53 across the axis OP of the plunger 14. Thus, as for a relationship between the portion 53*b* and the orientation of the ejected oil, this portion 53*b* of the base inner periphery portion 53 is more inclined to fall in the orientation of the ejected oil as the portion 53*b* nears the plunger's head portion 19. Hence in this embodiment also, the oil jet ji ejected from the oil supply hole 40 into the reservoir 24 is changed in direction by said one portion 53*b* of the base inner periphery portion 53, resulting in the re-directed stream jr that flows to the plunger's head portion 19 located far away from the high-pressure chamber 28.

Furthermore, since the oil supply hole 40 is formed in the inclined area 51*a* of the bulge portion 50 in such a way that its axis OF is oriented closely to a thick-wall direction (direction substantially normal to an inclined area), fabrication of the oil supply hole 40 in the plunger 14 can be easily performed and a machining burden on a cutting tool is reduced.

While the present invention has been described in conjunction with specific embodiments thereof, it should be noted that the present invention incorporates the following modes.

(1) A mode in which a unified plunger 14 consisting of a bottom-side plunger portion 22 integral with a head-side plunger portion 23 is used.

(2) A mode in which only the inclined areas (first inclined area 51*a* and second inclined area 51*b*) are allowed to be inclined and no first inclined periphery region 51 is formed anywhere on the entire inner circumferential periphery of the plunger 14.

(3) A mode in which a space formed between the rocker arm 4 (inner periphery of the recess 26) and the plunger's head portion 19 is utilized to discharge out oil from the communication hole 25 of the plunger's head portion 19. Accordingly, no communication hole 27 (as shown in FIGS. 1 and 3) may be excluded from the rocker arm 4.

BRIEF DESCRIPTION OF THE DRAWINGS

5 hydraulic lash adjuster
13 body
13*b* bottom
13*c* inner periphery of body
14 plunger
19 plunger's head portion
20 plunger's bottom portion
21 plunger's peripheral wall
24 reservoir (law-pressure chamber)
25 communication hole
28 high-pressure chamber
38 oil supply hole (oil introducing hole)
39 annular groove
40 oil supply hole
41 return spring (biasing means)
42 valve mechanism
50 bulge portion
51 first inclined periphery region
51*a* inclined area (one inclined area)
51*b* inclined area (the other inclined area)
53 base inner periphery portion
53*b* a portion of the base inner periphery portion (planar area, the other inclined area)
OF axis of oil supply hole
OP axis of plunger

The invention claimed is:

1. A hydraulic lash adjuster comprising:

a hollow plunger slidably fitted in a bottomed cylindrical body, with its head portion protruding from an open end of the bottomed cylindrical body;

a low-pressure chamber for storing oil therein, the low-pressure chamber formed in the hollow plunger utilizing an interior of the hollow plunger and in communication with an exterior and an exterior thereof via a communication hole formed in the head portion, a high-pressure chamber to be charged with oil, the high-pressure chamber formed between a bottom of the bottomed cylindrical body and a bottom of the hollow plunger in the bottomed cylindrical body;

an oil supply hole, formed in a peripheral wall of the plunger, for ejecting oil into the low-pressure chamber and for constituting an oil supply passage;

a biasing means disposed between the bottom of the bottomed cylindrical body and a bottom of the hollow plunger; and a valve mechanism disposed at a bottom of the hollow plunger and adapted to open a valve to allow for a flow of oil from the low-pressure chamber to the high-pressure chamber when the hollow plunger is extended by a restoring force of the biasing means, the hydraulic lash adjuster characterized in that:

an impingement area of the inner periphery of the hollow plunger subjected to impingement of oil ejected from the oil supply hole is inclined to fall in the direction of the ejected oil as the area nears the hollow plunger's head portion;

the hollow plunger is provided on its inner periphery with a pair of inclined areas opposing each other across an inner diameter of the hollow plunger;

the pair of inclined areas come closer to each other as they extend away from the head portion of the hollow plunger in the axial direction of the hollow plunger;

the oil supply hole is formed in a first of the pair of inclined areas with its opening facing an interior of the low-pressure chamber; and the oil supply hole is so set as to direct the orientation of the oil supply hole to a second of the pair of inclined areas so that the second inclined area serves as the impingement area.

2. The hydraulic lash adjuster according to claim 1, wherein:

the pair of inclined areas are arranged at an axial position of the hollow plunger closer to the bottom of the hollow plunger than to the hollow plunger's head portion; and the oil supply hole is provided in a region, most proximal to the bottom of the hollow plunger, of said first of the pair of inclined areas.

3. The hydraulic lash adjuster according to claim 1, wherein:

the hollow plunger is provided entirely along an inner circumference of its peripheral wall with a bulge portion that bulges radially inwardly in the hollow plunger;

the hollow plunger is provided on its inner periphery with a diametrically contracting inclined periphery region utilizing the bulge portion such that the diametrically contracting inclined periphery region has a contracting inner diameter that decreases as the diametrically contracting inclined periphery region extends away from the head portion of the hollow plunger in the axial direction of the hollow plunger;

each of the pair of inclined areas is formed by utilizing a portion of the diametrically contracting inclined peripheral region; and an oil introducing hole that constitutes the oil supply passage and faces an interior of the bulge portion is formed in a peripheral wall of the bottomed cylindrical body.

* * * * *